United States Patent [19]

LaCour

[11] Patent Number: 4,798,423

[45] Date of Patent: Jan. 17, 1989

[54] MODULAR DESK SYSTEM

[75] Inventor: Paul M. LaCour, Ridgewood, N.J.

[73] Assignee: LaCour Incorporated, Ridgewood, N.J.

[21] Appl. No.: 1,036

[22] Filed: Jan. 7, 1987

Related U.S. Application Data

[63] Continuation-in-part of Ser. No. 794,128, Nov. 1, 1985, abandoned.

[51] Int. Cl.[4] ..... A47B 21/00

[52] U.S. Cl. ..... 312/195; 108/50; 312/72; 312/196; 312/208; 312/223

[58] Field of Search ..... 312/194, 195, 196, 208, 312/223, 7.2, 239, 257 R, 257 SM; D6/421, 422, 423, 424, 425, 426, 427, 428; 108/50

[56] References Cited

U.S. PATENT DOCUMENTS

| | | | |
|---|---|---|---|
| D. 177,218 | 3/1956 | Collins | D6/426 X |
| D. 207,004 | 2/1967 | Carlson | D6/423 X |
| D. 251,592 | 4/1979 | Giancarlo . | |
| D. 251,666 | 4/1979 | Coon . | |
| D. 252,635 | 8/1979 | Richgels | D6/421 X |
| D. 275,284 | 8/1984 | Wells et al. . | |
| 1,886,766 | 11/1932 | Ulrich . | |
| 1,892,415 | 12/1932 | Ulrich . | |
| 2,230,444 | 2/1941 | Balster . | |
| 2,306,209 | 12/1942 | Elofson et al. . | |
| 2,694,614 | 11/1954 | Dent . | |
| 2,836,475 | 5/1958 | Sapp . | |
| 3,541,256 | 11/1970 | Anders | 312/196 X |
| 3,602,565 | 8/1971 | England, Jr. | 312/208 X |
| 3,862,785 | 1/1975 | Scheerhorn et al. . | |
| 3,883,202 | 5/1975 | Konig | 312/195 X |
| 3,964,401 | 6/1976 | Gutmann, Jr. et al. . | |
| 4,049,331 | 9/1977 | Gutmann, Jr. . | |
| 4,050,752 | 9/1977 | Dykstra | 312/195 X |
| 4,313,112 | 1/1982 | Foster . | |
| 4,316,082 | 2/1982 | Fritz . | |
| 4,345,803 | 8/1982 | Heck . | |
| 4,372,629 | 2/1983 | Propst et al. . | |
| 4,382,643 | 5/1983 | Heinrich . | |
| 4,387,941 | 6/1983 | Maier | 312/194 |
| 4,449,762 | 5/1984 | Turner . | |
| 4,458,961 | 7/1984 | Browning . | |
| 4,483,572 | 11/1984 | Story . | |
| 4,562,482 | 12/1985 | Brown | 312/208 X |
| 4,619,486 | 10/1986 | Hannah et al. | 312/196 X |

FOREIGN PATENT DOCUMENTS

| | | | |
|---|---|---|---|
| 6707 | 1/1980 | European Pat. Off. | 108/50 |
| 123972 | 11/1984 | European Pat. Off. | 312/223 |
| 160869 | 11/1985 | European Pat. Off. | 312/208 |
| 2160221 | 6/1973 | Fed. Rep. of Germany | 312/196 |
| 2744923 | 4/1979 | Fed. Rep. of Germany | 312/196 |
| 2480581 | 10/1981 | France | 312/195 |

OTHER PUBLICATIONS

Spec'built, Bankers Trust Trading Room/New York City, 4 pages.

*Primary Examiner*—Peter A. Aschenbrenner
*Assistant Examiner*—Thomas A. Rendos
*Attorney, Agent, or Firm*—Ralph W. Selitto, Jr.

[57] ABSTRACT

A modular desk system employs two work tops which are arranged so as to define a pair of back-to-back work stations. The work tops are cantileverd from a core, which is common to both of the work stations. A pedestal or an end panel supports the free end of each work top. The core has a substantially unobstructed, interior raceway for data, communication and electrical service lines and accessory equipment. The top of the core is substantially open so that a communication and data turret removably mounted on the core can be partially sunk into the raceway.

30 Claims, 11 Drawing Sheets

MODULAR DESK SYSTEM

CROSS-REFERENCE TO RELATED APPLICATION

This application is a continuation-in-part of pending U.S. patent application Ser. No. 794,128, filed Nov. 1, 1985 now abandoned.

FIELD OF THE INVENTION

The present invention relates to a modular desk system, and, more particularly, to such a system which is especially adapted to house data and communication equipment, such as telephones and computer terminals.

BACKGROUND OF THE INVENTION

With the advent of microprocessor computers, the use of electronic data and communication systems has proliferated, especially in the business sector. For instance, in the foreign exchange and money market dealing field, it is common to provide trading rooms with a plurality of work stations, each station typically including a variety of data and communication equipment such as a computer keyboard, computer display screens in the form of cathode ray tubes, a telephone turret with a specified number of direct lines and telephone line monitoring units and other peripheral devices. In order to make maximum use of the available floor space in the trading room, the work stations are oftentimes ganged together to form a cluster of work stations. Such clusters can be formed by arranging several double work stations (i.e., two work stations arranged in back-to-back fashion) side-by-side, the resulting cluster comprising two rows of back-to-back work stations.

Computer work stations have been developed in the past (see, for instance, U.S. Pat. Nos. Des. 251,666, Des. 275,284, 4,316,082, 4,345,803 and 4,449,762). While some of these work stations have a modular construction (see, for instance, U.S. Pat. Nos. 4,313,112 and 4,458,961) and others are adapted to be ganged together (see, for instance, U.S. Pat. No. Des. 251,592), they are not specifically designed to be arranged in back-to-back or side-by-side fashion. Thus, these work stations are not especially suitable for the formation of clusters which comprise two rows of work stations arranged back-to-back. As a result, such clusters have, in the past, been formed by arranging conventional desks in back-to-back and side-by-side fashion (see, for instance, U.S. Pat. Nos. 1,886,766 and 2,694,614).

One problem encountered when ganging together the conventional desks or computer work stations described above involves providing adequate room for and access to the necessary telephone, data and electrical service lines and accessory equipment. Without adequate room for and access to such service lines and accessory equipment, field installation and maintenance can be made difficult.

Although there is one known type of computer work station which as a modular construction and is adapted for clustering, each work station in the cluster has its own individual raceway which is separate and autonomous from the raceway of an adjoining work station in an adjacent row. Thus, the size of each raceway is limited. Moreover, each work station itself is an individual unit which is separate and autonomous from the other work stations in the cluster.

SUMMARY OF THE PRESENT INVENTION

The problems and disadvantages of the prior art discussed above are overcome in accordance with the present invention by providing a modularly constructed desk system in which a freestanding core is provided with a substantially open top and a substantially unobstructed raceway adapted to house all necessary telephone, data and electrical service lines and accessory equipment. Generally horizontal desk tops, each of which forms a work station, are removably and replaceably attached to opposite sides of the core, an outer portion of each desk top being supported by a storage pedestal or an end panel. One or more turrets are removably and replaceably mounted on the core above the raceway. Because the top of the core is substantially open, the turret or turrets, which will often house data and communication equipment, can be partially sunk into the raceway, reducing the overall height of the turret or turrets and ensuring a necessary clear line of sight throughout the room in which the desk system is installed.

The modular construction of the desk system is advantageous because it facilitates field installation and maintenance of the system itself. The modular construction also provides for flexibility in that the configuration of the desk system can be varied by adding or subtracting modules. As a result of their removable attachment to the core, the turrets can be removed and replaced with new turrets designed, for instance, to conform to changes in data and communication equipment specifications. Thus, the concept of providing removable and replaceable turrets also contributes to the flexibility of the system. The provision of a separate, substantially unobstructed raceway for the required telephone, data and electrical service lines and accessory equipment facilitates installation and servicing of such lines and equipment. Because the core is common to at least two work stations, the number of parts required to form a cluster of work stations can be decreased. Moreover, the size of the raceway, which is also common to at least two work stations, defined by such a common core can be larger than the raceways employed by the prior art desk systems.

BRIEF DESCRIPTION OF THE DRAWINGS

For a more complete understanding of the present invention, reference is made to the following detailed description of three exemplary embodiments considered in conjunction with the accompanying drawings, in which.

DESCRIPTION OF THE EXEMPLARY EMBODIMENTS

Although the present invention is applicable to many different types of data and communication desk systems, it is especially suitable for use in connection with foreign exchange and money market dealing desk systems. Accordingly, the present invention will be described in connection with a foreign exchange and money market dealing desk systems.

Figure 1:
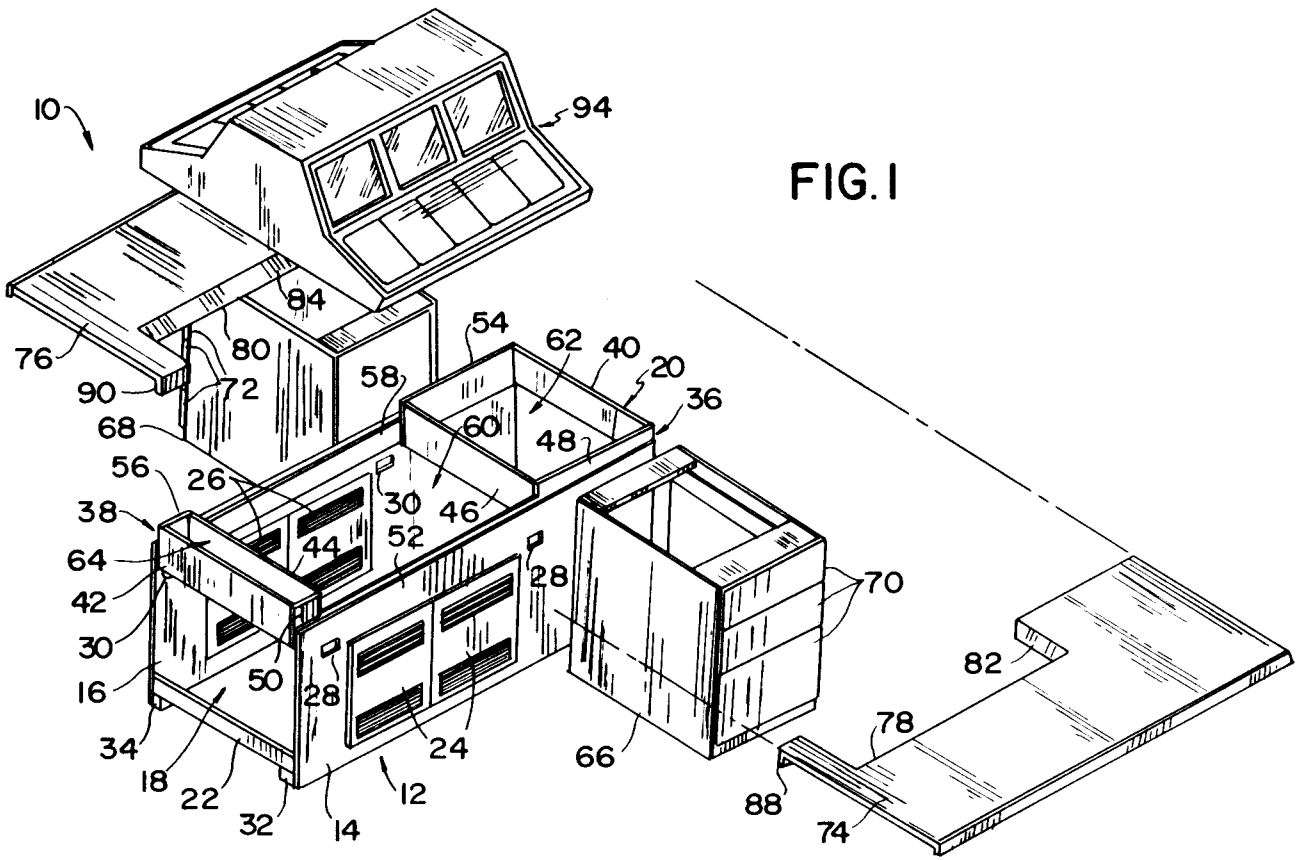
FIG. 1 is an exploded perspective view of a modular trading desk system constructed in accordance with one exemplary embodiment of the present invention.
Figure 4:
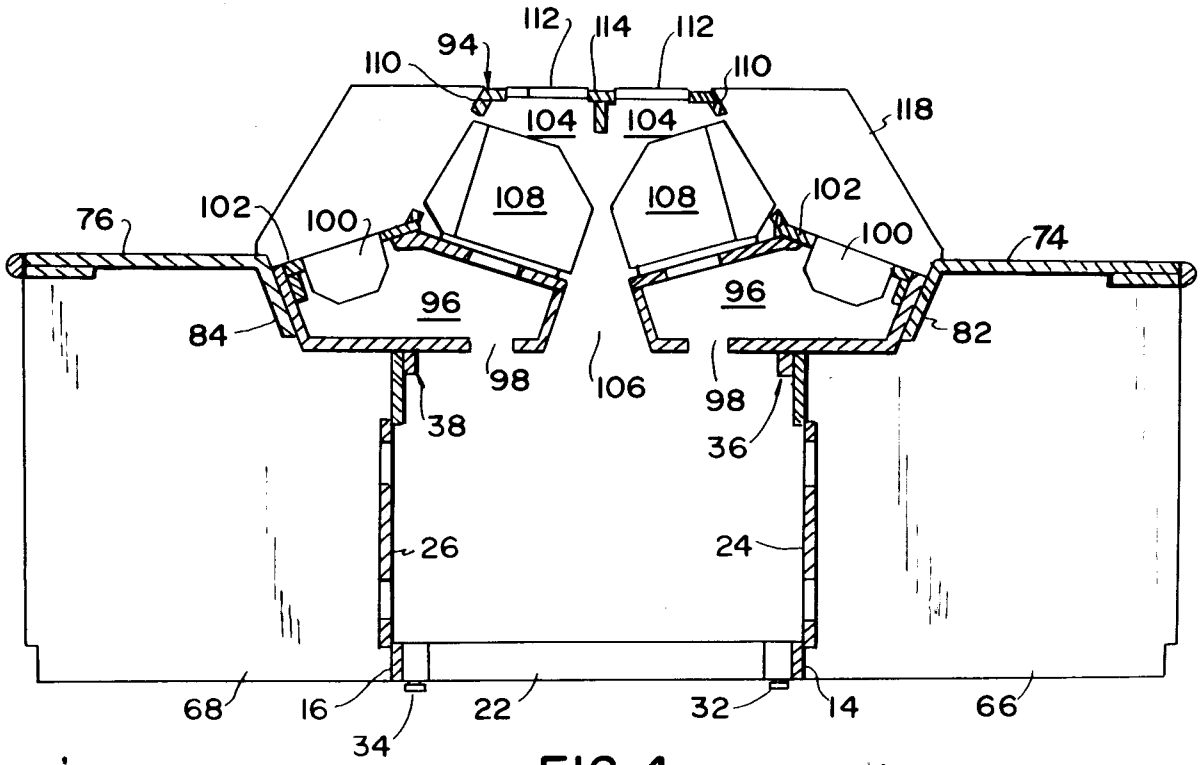
FIG. 4 is a cross-sectional view, taken along the line IV—IV of FIG. 2 and looking in the direction of the arrows.
Figure 5:
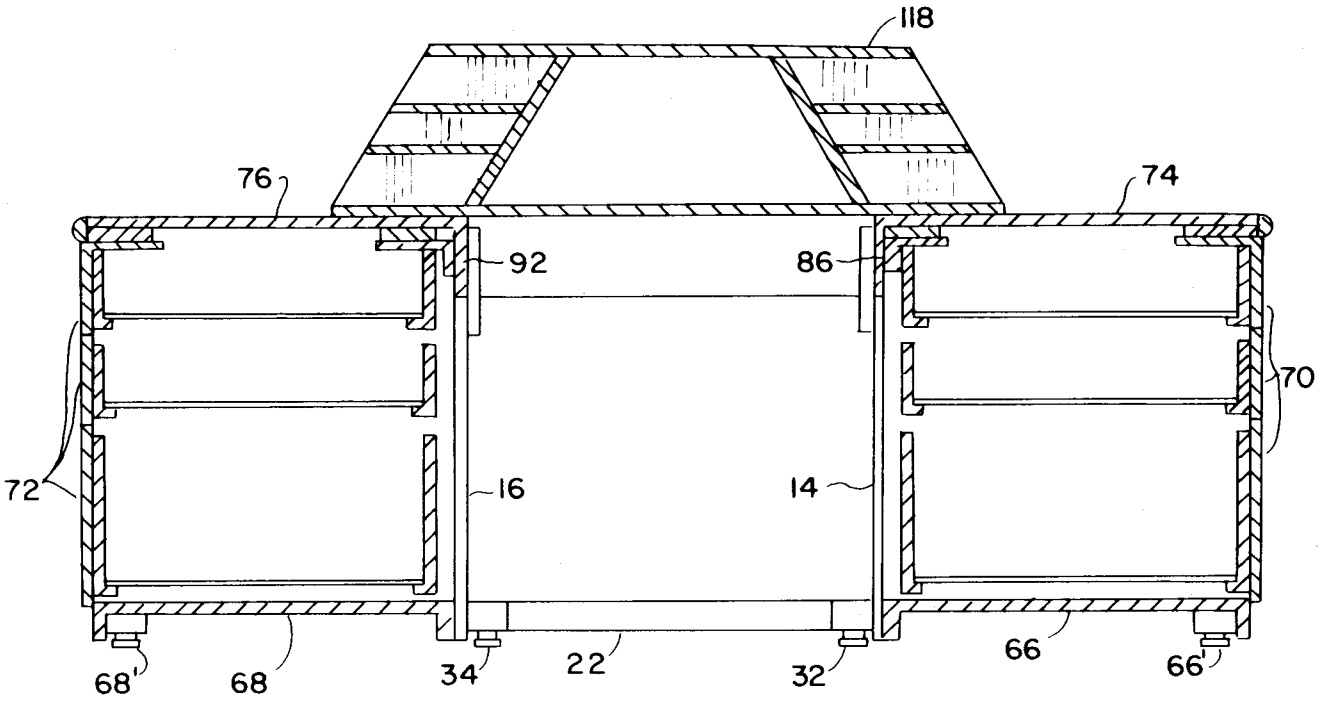
FIG. 5 is a cross-sectional view, taken along line V—V of FIG. 2 and looking in the direction of the arrows.
Figure 6:
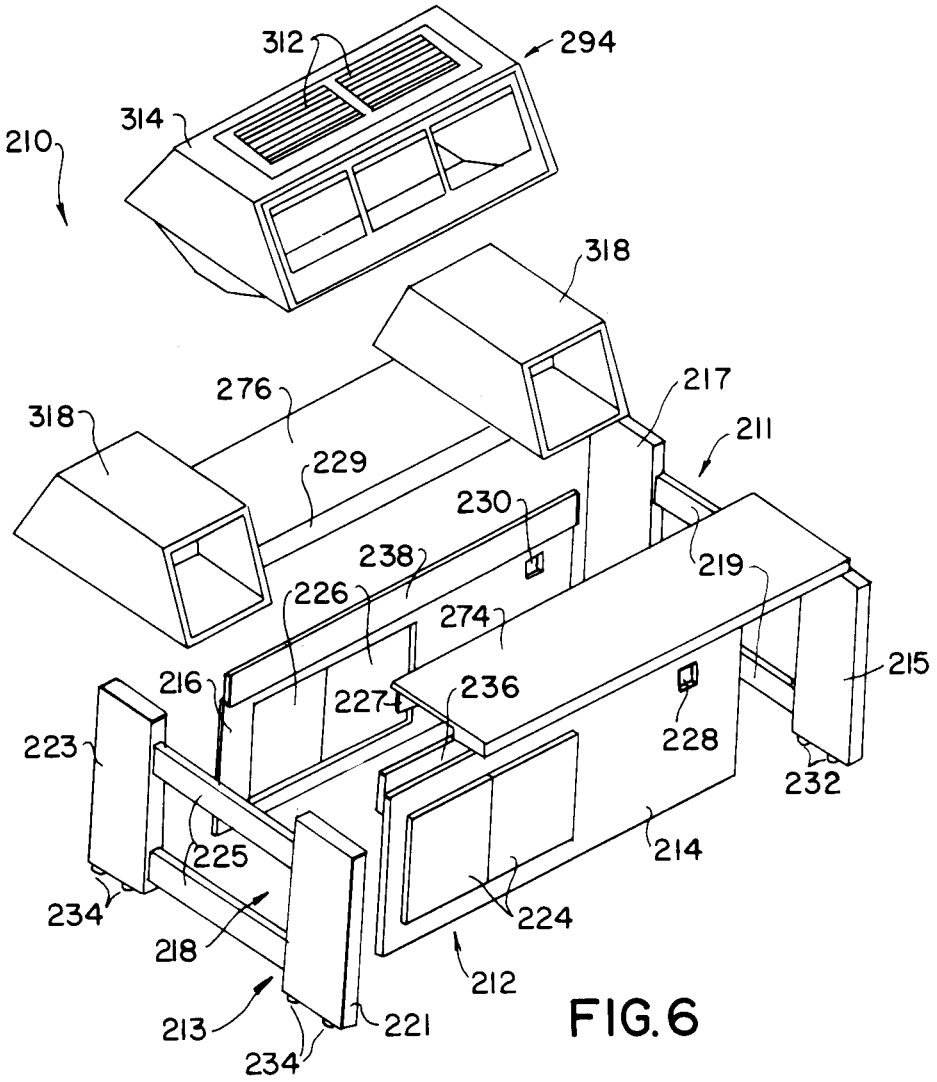
FIG. 6 is an exploded perspective view of a modular trading desk system constructed in accordance with a second exemplary embodiment of the present invention.
Figure 7:
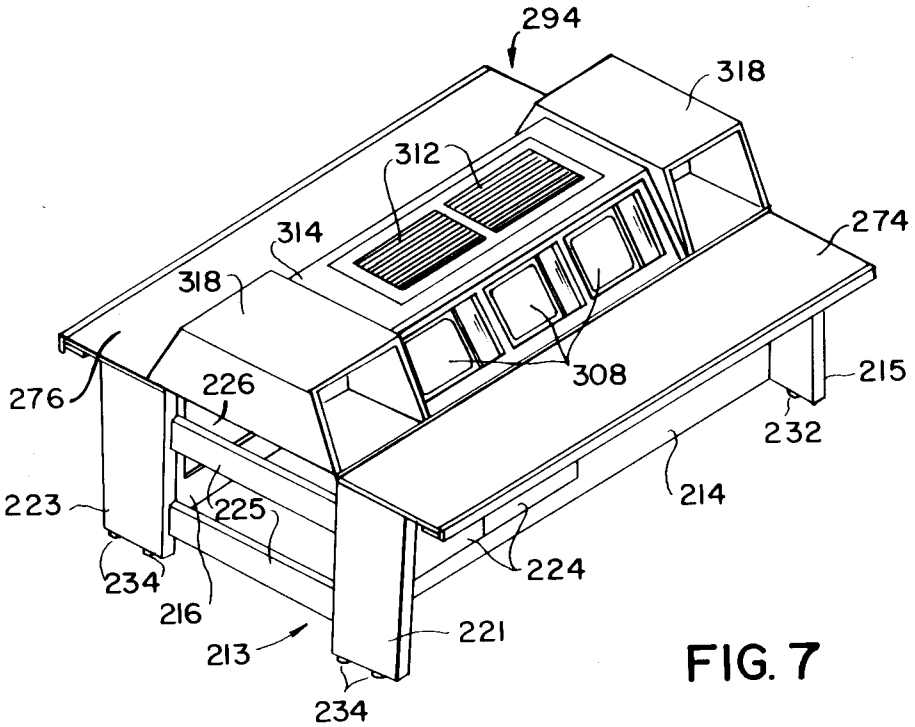
FIG. 7 is a perspective view of the trading desk system illustrated in FIG. 6.
Figure 8:
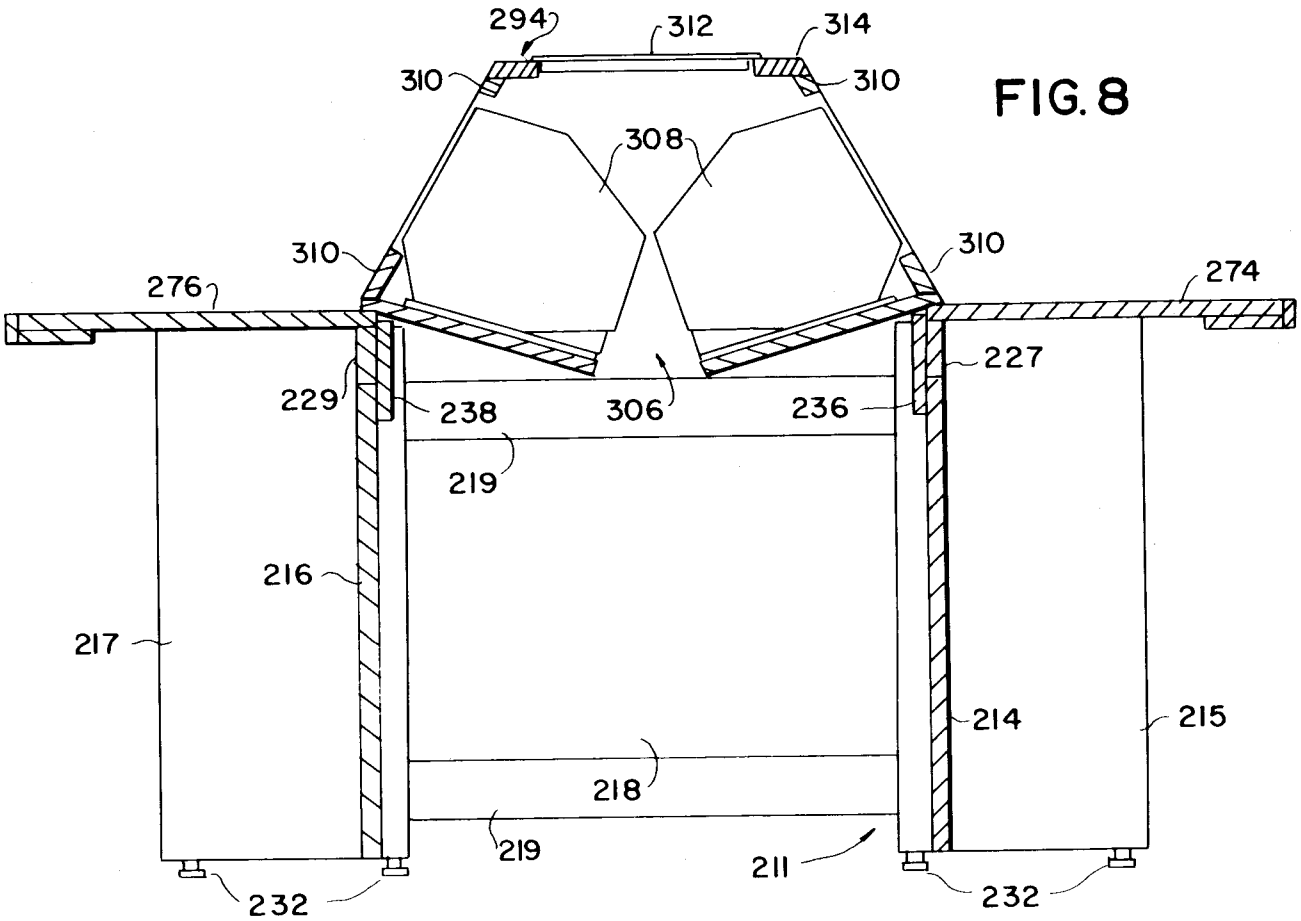
FIG. 8 is a cross-sectional view of the trading desk system illustrated in FIGS. 6 and 7, the cross section being taken along a line similar in orientation to the line IV—IV of FIG. 2.

Referring primarily to FIG. 1, a foreign exchange and money market dealing desk system 10 includes a raceway core 12 made from vertical face panels 14, 16 which cooperate to define a substantially unobstructed raceway 18 therebetween. The raceway 18 is large enough to accommodate telephone, data and electrical service lines and accessory equipment to be described in more detail hereinafter. A cradle 20 connected to the face panels 14, 16 bridges the raceway 18. Moreover, the size of the raceway (such size actually permitting an individual to enter the raceway) and its unobstructed nature facilitate increased servicibility by the technicians responsible for the telephone and telecommunications equipment. Splines 22 also extend between the face panels 14, 16 (see also FIGS. 4 and 5). The face panels 14, 16 are provided with access doors 24, 26, respectively, which are adapted to ventilate the raceway 18, as well as to provide access to the raceway 18. Cutouts 28, 30 in the face panels 14, 16, respectively, are provided for electrical outlet boxes (not shown) which provide power to the user's calculators, etc. The face panels 14, 16 also include levelers 32, 34, respectively, adapted to permit leveling of the raceway core 12 (see also FIGS. 4 and 5).

The cradle 20 includes rails 36, 38, which are attached to the face panels 14, 16, respectively. Outer stiles 40, 42 extend across the raceway 18 between the rails 36, 38, while inner stiles 44, 46 extend across the raceway 18 between the rails 36, 38. The rail 36 has ends 48, 50, which project above the face panel 14 for a purpose to be described hereinafter, and an intermediate portion 52, which is at the same elevation as the face panel 14. The rail 38 has ends 54, 56, which project above the face panel 16 for a purpose to be described hereinafter, and an intermediate portion 58, which is at the same elevation as the face panel 16. The intermediate portions 52, 58 of the rails 36, 38, respectively, cooperate with the inner stiles 44, 46 to delimit a main access opening 60, which is adapted to provide access for data, communication and electrical service lines (not shown). The ends 48, 54 of the rails 36, 38, respectively, cooperate with the outer stile 40 and the inner stile 44 to form a large auxiliary access opening 62, which is adapted to provide access for additional data, communication and electrical service lines (not shown), if such additional lines happen to be necessary. Similarly, the ends 50, 56 of the rails 36, 38, respectively, cooperate with the outer stile 42 and the inner stile 44 to form a small auxiliary access opening 64, which is adapted to provide access for additional data, communication and electrical service lines (not shown), if such additional lines happen to be necessary.

Pedestals 66, 68 are positioned alongside the face panels 14, 16, respectively. The pedestals 66, 68 include drawers 70, 72, respectively, for storage and filing purposes. In order to level the pedestals 66, 68, each one is provided with levelers 66', 68', respectively (see FIG. 5).

The desk system 10 also includes a pair of work tops 74, 76, which are provided with cutouts 78, 80, respectively, bordered by generally U-shaped collars 82, 84, respectively, Cleats 86, 88 (see also FIG. 5) depend from the work top 74 on opposite sides of the cutout 78, the cleats 86, 88 being tied to the collar 82 for rigidity. Similarly, cleats 90, 92 (see also FIG. 5) depend from the work top 76 on opposite sides of the cutout 80, the cleats 90, 92 being tied into the collar 84 for rigidity. The cleats 86, 88 of the work top 74 rest on the face panel 14 and are attached to the ends 48, 50, respectively, of the rail 36. Similarly, the cleats 90, 92 of the work top 76 rest on the face panel 16 and are attached to the ends 54, 56, respectively, of the rail 38. Work tops 74, 76 are also attached to pedestals 66, 68, respectively.

A communication and data turret 94 is removably mounted in the open space formed by the main access opening 60 in the raceway core 12 and the cutouts 78, 80 in the work tops 74, 76, respectively, the turret 94 being supported by the face panels 14, 16 and the intermediate portions 52, 58 of the rails 36, 38 of the cradle 20. More particularly, and with reference to FIG. 4, the turret 94 has a pair of lower chambers 96, each of which includes access openings 98 adapted to permit the passage of data, communication and electrical service lines (not shown) from the raceway 18 to a plurality of telephone tubs 100 housed in the lower chambers 96 of the turret 94 and framed by removable inserts 102 which provide access to the telephone tubs 100. The turret 94 also includes a pair of upper chambers 104. An access opening 106 between the upper chambers 104 permits data, communication and electrical service lines (not shown) to be run from the raceway 18 to a plurality of computer data monitors 108 (in the form of cathode ray tubes) mounted in the upper chambers 104 of the turret 94 and framed by removable inserts 110. Grills 112 provided in an upper surface 114 of the turret 94 permit ventilation of the upper chambers 104 and provide access to the monitors 108, such access also being provided by the inserts 110. The utilization of frame inserts 110 and 102 facilitates future adaptation of telephone and telecommunications equipment by their removal and substitution of new inserts designed to accommodate future specified equipment.

Because of its modular construction, the desk system 10 can be quickly and easily installed in the field. For instance, after positioning the raceway core 12, which is preferably preassembled, the pedestals 66, 68 are properly positioned with respect to the raceway core 12. With the pedestals 66, 68 in place, the work tops 74, 76 are attached to the cradle 20 of the raceway core 12 and to the pedestals 66, 68. The desk system 10 is then leveled using levelers 32, 34, 66', 68'. After such leveling, the turret 94 is dropped into place over the access opening 60 and then attached to the collars 82, 84 of the work tops 74, 76, respectively. After such assembly, the desk system 10 forms two back-to-back work stations and is adapted so that it can be combined with other similar desk systems to form a cluster of several work stations (see FIGS. 2 and 3).

Figure 2:
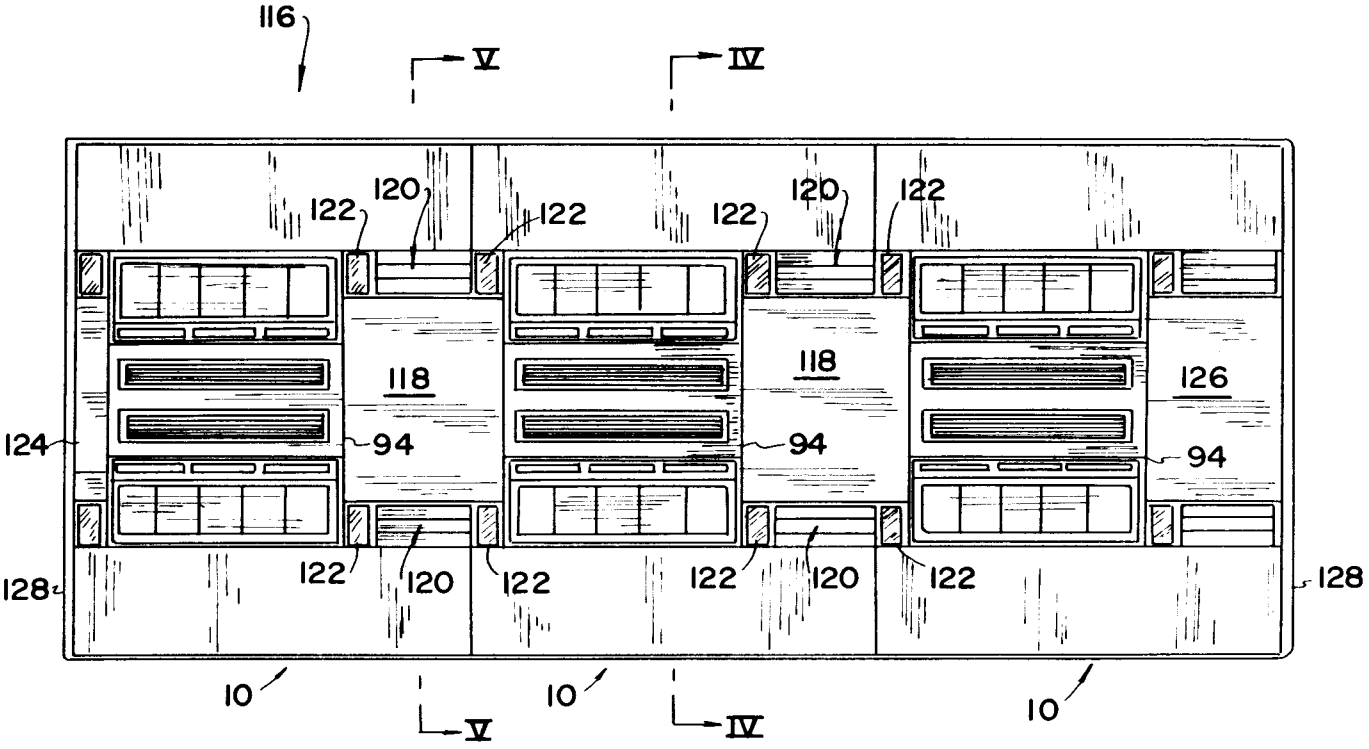
FIG. 2 is a plan view showing a work station cluster formed from three of the trading desk system illustrated in FIG. 1.
Figure 3:
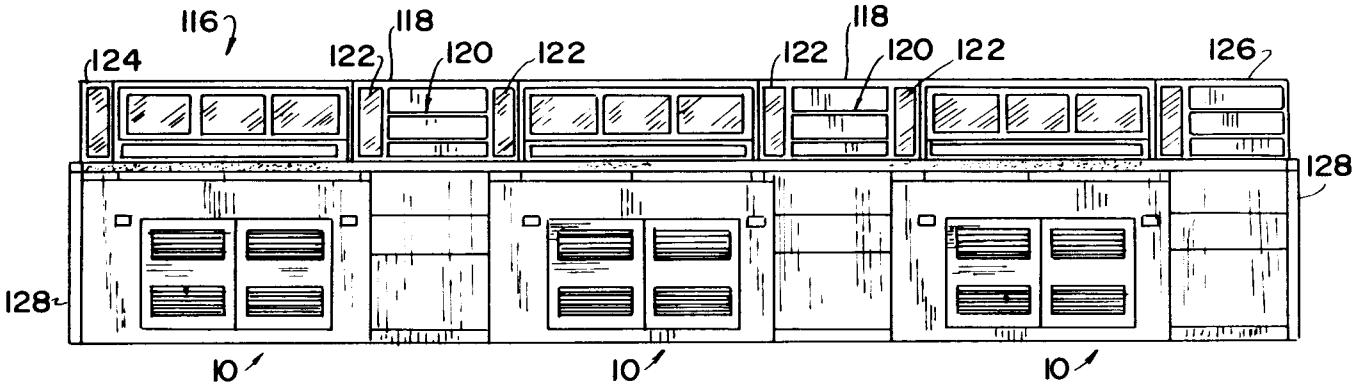
FIG. 3 is an elevational view of the work station cluster shown in FIG. 2.

Referring now to FIGS. 2 and 3, there is shown a cluster 116 of several work stations formed from three of the desk systems 10 shown in FIG. 1. In addition to the elements described above in connection with the desk system 10, the cluster 116 includes spanning secondary turrets 118 arranged between adjacent communication and data turrets 94. Each spanning secondary turret 118 includes adjustable shelves 120 and speaker columns 122 adapted to house line monitoring units (not shown). A short ending secondary turret 124 is arranged at one end of the cluster 116, while a long ending secondary turret 126 is arranged at the opposite end of the cluster 116. End panels 128 are attached to the opposite ends of the cluster 116, each of the end panels 128 being provided with levelers (not shown) for leveling the end panels 128. Instead of using the end panels 128, a special single station desk system could be provided at one end or both ends of the cluster 116. Such a single station desk system would be constructed in a manner similar to the desk system 10.

The desk system 10 is advantageous because it provides flexibility in that it can be combined with other similar desk system to form a variety of different cluster configurations. Because the core 12 is common to two work stations, each being defined by one of the work tops 74, 76, the number of parts required to form a cluster of work stations can be decreased. Moreover, because the raceway 18 is substantially open, the communication and date turret 94 can be sunk as low as possible, thereby lowering the overall height of the desk system 10 to thereby increase visibility throughout the trading room which houses the desk system 10. The comparatively large size of the raceway 18, which is at least partially attributable to the fact that the raceway 18 is common to a pair of back-to-back work stations, and its substantially open construction facilitate wiring of the necessary electrical equipment. The modular construction of the desk system 10 also facilitates installation in the field.

Another exemplary embodiment of the present invention is illustrated in FIGS. 6–11. Elements illustrated in FIGS. 6–11 which correspond to the elements described above with respect to the embodiment of FIGS. 1–5 have been designated by corresponding reference numerals increased by two hundred. The embodiment of FIGS. 6–11 is constructed and can be assembled in the same basic manner as the embodiment of FIGS. 1–5 unless otherwise stated.

Another exemplary embodiment of the present invention is illustrated in FIGS. 6–11 which correspond to the elements described above with respect to the embodiment of FIGS. 1–5 have been designated by corresponding reference numerals increased by two hundred. The embodiment of FIGS. 6–11 is constructed and can be assembled in the same basic manner as the embodiment of FIGS. 1–5 unless otherwise stated.

Referring to FIGS. 6–11, a foreign exchange and money market dealing desk system 210 includes a raceway core 212 made from vertical face panels 214, 216 which cooperate to define a substantially unobstructed raceway 218 therebetween. The raceway 218 is large enough to accommodate telephone, data and electrical service lines and accessory equipment. The face panels 214, 216 are provided with access doors 224, 226, respectively, which are adapted to ventilate the raceway 218, as well as to provide access to the raceway 218. Cutouts 228, 230 in the face panels 214, 216, respectively, are provided for electrical outlet boxes (not shown), which provide power to the user's desk top calculator, etc. Rails 236, 238 extend upwardly from the face panels 214, 216, respectively.

The face panels 214, 216 are supported by end assemblies 211, 213. The end assembly 211 includes end panels 215, 217 which are connected by ties 219 and which include levelers 232. Similarly, the end assembly 213 includes end panels 221 223 which are connected by ties 225 and which include levelers 234.

The desk system 210 also includes a pair of work tops 274, 276 which are provided with downwardly extending cleats 227, 229, respectively. The cleat 227 of the work top 274 rests on the face panel 214 and is attached to the rail 236. Similarly, the cleat 229 of the work top 276 rests on the face panel 216 and is attached to the rail 238. The work top 274 is also supported by the end panels 215, 221 of the end assemblies 211, 213, respectively. Similarly, the work top 276 is also supported by the end panels 217, 223 of the end assemblies 211, 213, respectively.

A communication and data turret 294 is removably mounted over the open raceway 218, the turret 294 being supported by the work tops 274, 276 such that the turret 294 is partially sunk into the raceway 218. An access opening 306 (see FIG. 8) in the bottom of the turret 294 permits data, communication and electrical service lines (not shown) to be run from the raceway 218 to a plurality of computer data monitors 308 (see FIGS. 7 and 8) mounted in the turret 294 and framed by removable inserts 310 (see FIG. 8). Grills 312 provided in an upper surface 314 of the turret 294 permit ventilation of the turret 294 and provide access to the monitors 308, such access also being provided by the inserts 310.

Figure 9:
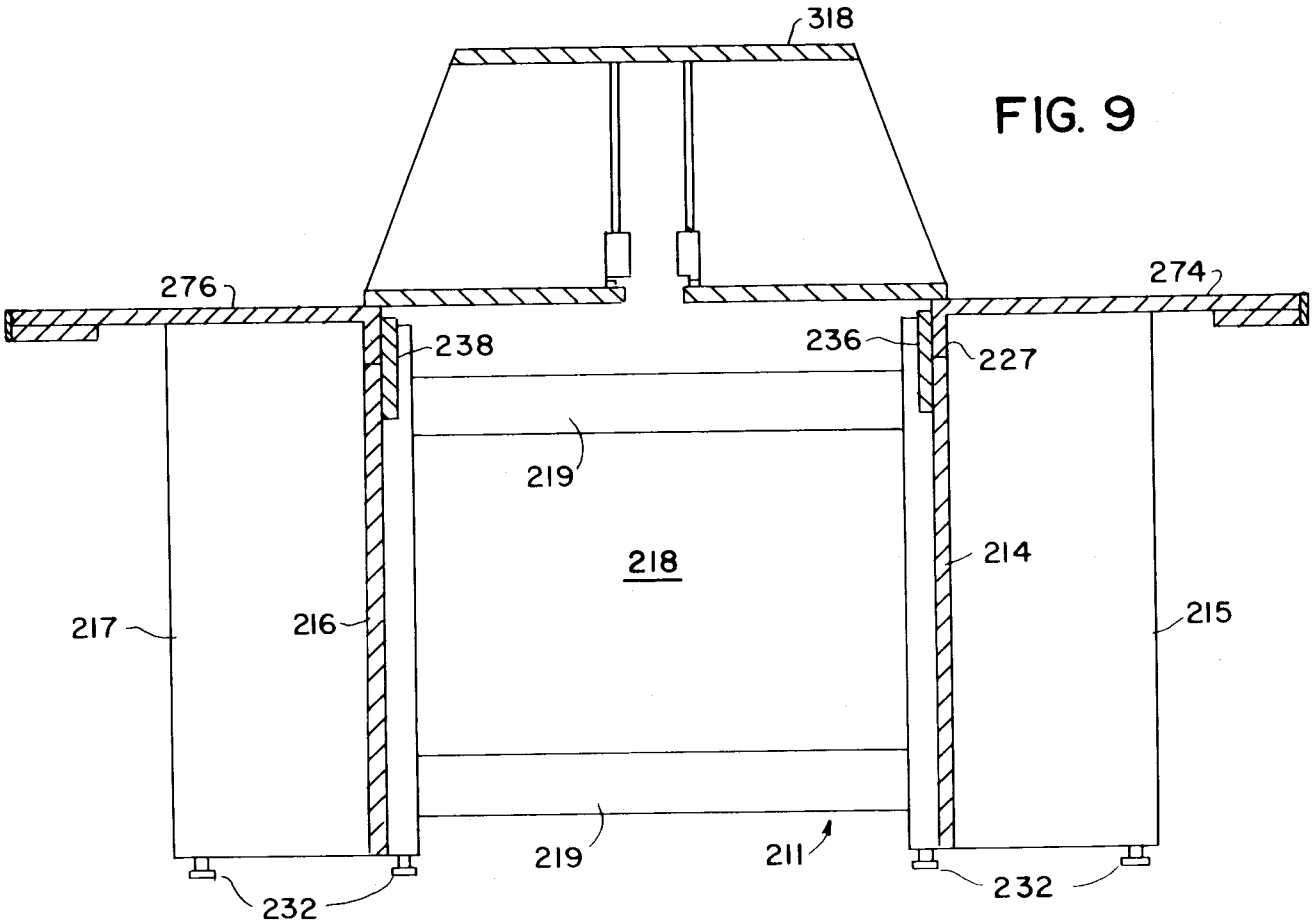
FIG. 9 is a cross-sectional view of the trading desk system illustrated in FIGS. 6 and 7, the cross section being taken along a line similar in orientation to the line V—V of FIG. 2.

Secondary turrets 318 are removably mounted over the open raceway 218, the turrets 318 being supported by the work tops 274, 276 (see FIG. 9). Unlike the turret 294, the turrets 318 are not sunk into the raceway 218. If there are no height restrictions on the desk system 210, the monitors 308 could be mounted on a flap plate which bridges the raceway 218 in the same manner that the turrets 318 bridge the raceway 218, thereby eliminating the partially sunk turret 294.

Figure 10:
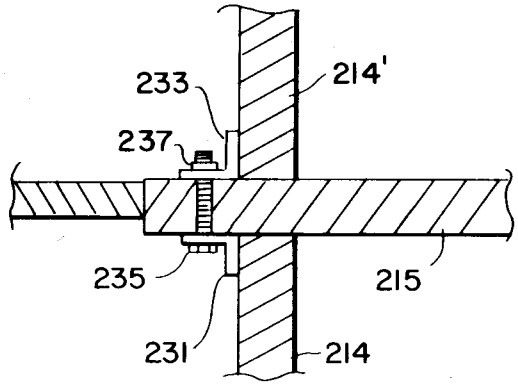
FIG. 10 is a partial cross-sectional view showing one technique for arranging the trading desk system of FIG. 6 in side-by-side fashion with another similar trading desk system.

With reference to FIG. 10, the end panel 215 is connected to the face panel 214 and to another face panel 214' of an adjacent desk system by brackets 231, 233 and a bolt 235, which extends between the brackets 231, 233 through the end panel 214 and is secured in place by a nut 237. By this arrangement, two desk systems can be arranged in side-by-side fashion to form a cluster of work stations without the use of a pedestal or a similar structural element to support the abutting work tops (not shown) of the adjacent desk systems.

Figure 11:
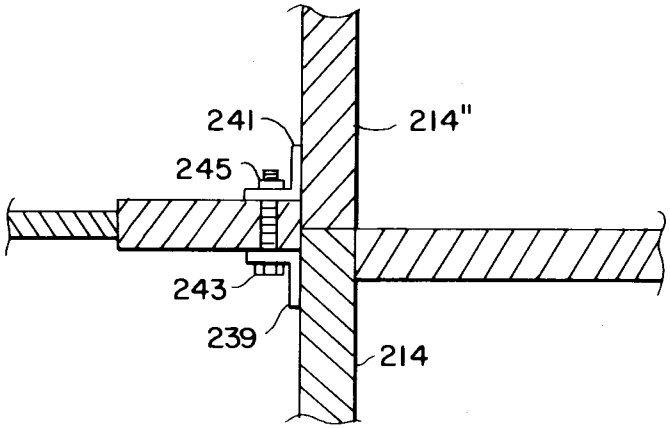
FIG. 11 is a partial cross-sectional view showing another technique for arranging the trading desk system of FIG. 6 in side-by-side fashion with another similar trading desk system.

Referring now to FIG. 11, the face panel 214 abuts another face panel 214'' of an adjacent desk system by brackets 239, 241 and a bolt 243, which extend between the brackets 239, 241 through the end panel 215 and is secured in place by a nut 245. Because the end panel 215 is not available to support the abutting work tops (not shown) of the adjacent desk systems, a pedestal 247 (only a portion of which is shown) is employed in order to provide such support.

Figure 12:
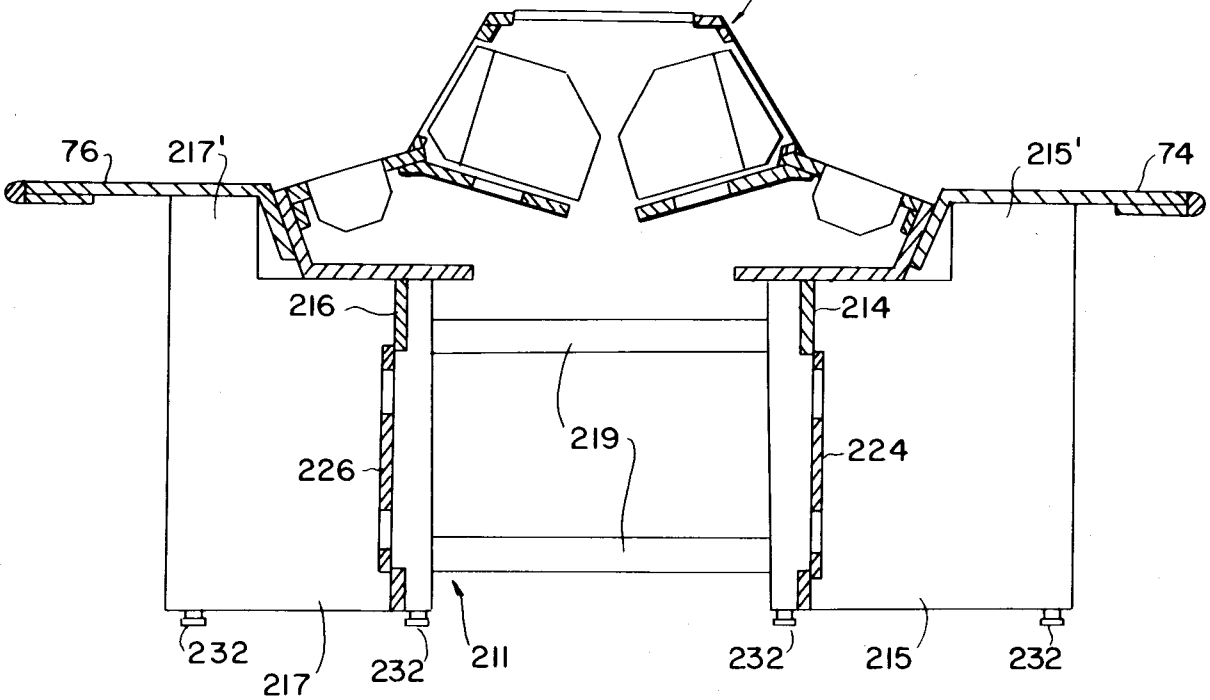
FIG. 12 is a cross-sectional view similar to FIGS. 4 and 8 showing a modular trading desk system constructed in accordance with a third exemplary embodiment of the present invention.

A still further embodiment of the present invention is illustrated in FIG. 12. Inasmuch as the embodiment of FIG. 12 is a combination of the embodiment illustrated in FIGS. 6–11, elements illustrated in FIG. 12 which correspond to the elements described above with respect to the embodiments of FIGS. 1–5 and the embodiment of FIGS. 6–11 have been designated by corresponding reference numerals. The embodiment of FIG. 12 is constructed and can be assembled in the same basic manner as the embodiments of FIGS. 1–11 unless otherwise stated.

Referring now to FIG. 12, an end assembly 211, which includes end panels 215, 217 and ties 219, helps support face panels 214, 216, which are provided with access doors 224, 226, respectively. The end panels 215, 217 include levelers 232. Unlike the embodiment of FIGS. 6–11, the end panels 215, 217 have extensions 215', 217', respectively, adapted to facilitate the support of work tops 74, 76. A turret 94 is supported between the work tops 74, 76 by the face panels 214, 216.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A desk system, comprising a core having an interior raceway, a substantially open top, a first face panel on one side of said core and a second face panel on an opposite side of said core; a first work top extending outwardly from said one side of said core, said first work top having an inner edge which is directly supported by said first face panel; a second work top extending outwardly from said opposite side of said core, said second work top having an inner edge which is directly supported by said second face panel such that said second work top is arranged in substantially back-to-back relationship with said first work top, whereby said first and second work tops define a pair of back-to-back work stations, said core being common to both of said work stations; first supporting means extending downwardly from said first work top for supporting an outer portion of said first work top; second supporting means extending downwardly from said second work top for supporting an outer portion of said second work top; and covering means for covering said top of said core, said covering means including a turret which is common to both of said work stations and which is partially sunk into said raceway through said top of said core, said turret including housing means for housing computer data monitors such that at least one of said computer data monitors faces one of said work stations and at least another of said computer data monitors faces the other of said work stations and such that each of said computer data monitors extends below said first and second work tops to thereby reduce the distance that said turret projects above said work tops.

2. A desk system according to claim 1, wherein said housing means houses data and communication equipment.

3. A desk system according to claim 2, wherein said housing means includes a first upper chamber on one side of said turret for data equipment, including said at least one computer data monitor, a second upper chamber on an opposite side of said turret for additional data equipment, including said at least another computer data monitor, a first lower chamber on said one side of said turret for communication equipment, and a second lower chamber on said opposite side of the turret for additional communication equipment.

4. A desk system according to claim 3, wherein said turret includes a first access opening communicating between said raceway and said first and second upper chambers, whereby data service lines can run from said raceway to said first and second upper chambers, a second access opening communicating between said raceway and said first lower chamber, whereby communication service lines can run from said raceway to said first lower chamber, and a third access opening communication between said raceway and said second lower chamber, whereby communication service lines can be run from said raceway to said second lower chamber.

5. A desk system according to claim 3, wherein said first work top includes a cutout in an inner edge thereof and said second work top includes a cutout in an inner edge thereof.

6. A desk system according to claim 5, wherein said first lower chamber of said turret extends outwardly from said core into said cutout in said first work top and said second lower chamber of said turret extends outwardly from said core into said cutout in said second work top.

7. A desk system according to claim 1, further comprising first accessing means in said first face panel for accessing said raceway from said one side of said core and second accessing means in said second face panel for accessing said raceway from said opposite side of said core.

8. A desk system according to claim 7, wherein said top of said core includes a first opening located adjacent to one end of said core, a second opening located adjacent to an opposite end of said core, and a third opening located between said first and second openings, said third opening being sized and shaped so as to receive a portion of said turret which is sunk into said raceway.

9. A desk system according to claim 8, wherein said cord is a freestanding module.

10. A desk system according to claim 1, further comprising connecting means on one end of said core for connecting said desk system to another similar desk system in end-to-end fashion.

11. A desk system according to claim 10, further comprising another connecting means on an opposite end of said core for connecting said desk system to yet another similar desk system in end-to-end fashion.

12. A desk system according to claim 10, wherein said first and second work tops of each of said desk systems defines a work station, whereby said work stations are arranged in two back-to-back rows.

13. A desk system according to claim 1, wherein said first and second work tops are removably attached to said core, whereby said first and second work tops can be provided as individually replaceable modules.

14. A desk system according to claim 13, wherein said turret is removably mounted on said core, whereby said turret can be provided as an individually replaceable module.

15. A desk system according to claim 1, wherein said turret is supported by said core.

16. A desk system according to claim 15, wherein said first supporting means includes a first end panel positioned on one side of said core and extending downwardly from said first work top and said second supporting means includes a second end panel positioned on an opposite side of said core and extending downwardly from said second work top.

17. A desk system according to claim 15, wherein said first supporting means includes a first pedestal positioned on one side of said core and extending downwardly from said first work top and said second supporting means includes a second pedestal positioned on an opposite side of said core and extending downwardly from said second work top.

18. A desk system according to claim 1, wherein said turret is supported by said first and second work tops.

19. A desk system according to claim 18, wherein said first supporting means includes a first end panel positioned on one side of said core and extending downwardly from said first work top and said second supporting means includes a second end panel positioned on an opposite side of said core and extending downwardly from said second work top.

20. A desk system according to claim 18, wherein said first supporting means includes a first pedestal positioned on one side of said core and extending downwardly from said first work top and said second supporting means includes a second pedestal positioned on an opposite side of said core and extending downwardly from said second work top.

21. A desk system according to claim 1, wherein said housing means includes a first support surface on which said at least one of said computer data monitors rests and a second support surface on which said at least another of said computer data monitors rests, said first and second support surfaces sloping downwardly into said raceway from opposite sides of said turret and being spaced apart a distance sufficient to provide access to said computer data monitors from within said raceway.

22. A desk system according to claim 1, wherein said raceway is large enough to constitute a crawlspace.

23. A cluster of work stations, comprising a plurality of modular desk systems, each of said desk systems including a core having an interior raceway, a substantially open top, a first face panel on one side of said core and a second face panel on an opposite side of said core, a first work top extending outwardly from said one side of said core, said first work top having an inner edge which is directly supported by said first face panel, a second work top extending outwardly from said opposite side of said core, said second work top having an inner edge which is directly supported by said second face panel such that said second work top is arranged in substantially back-to-back relationship with said first work top, whereby said first and second work tops define a pair of back-to-back work stations, said core being common to both of said work stations, first supporting means extending downwardly from said first work top for supporting an outer portion of said first work top, second supporting means extending downwardly from said second work top for supporting an outer portion of said second work top, covering means for covering said top of said core, said covering means including a turret which is common to both of said work stations and which is partially sunk into said raceway through said top of said core, said turret including housing means for housing computer data monitors such that at least one of said computer data monitors faces one of said work stations and at least another of said computer data monitors faces the other of said work stations and such that each of said computer data monitors extends below said first and second work tops to thereby reduce the distance that said turret projects above said work tops, and connecting means for connecting at least some of said desk systems in end-to-end fashion, whereby said cluster of work stations includes two rows of back-to-back work stations.

24. A cluster of work stations according to claim 23, further comprising secondary turrets positioned on opposite sides of said primary turrets.

25. A cluster of work stations according to claim 24, wherein said secondary turrets include spanning turrets which span adjacent desk systems between said primary turrets thereof.

26. A cluster of work stations according to claim 25, wherein said secondary turrets include ending turrets at each end of said rows of back-to-back work stations.

27. A cluster of work stations according to claim 23, wherein said primary turret is mounted on said core between said first and second work tops.

28. A cluster of work stations according to claim 23, wherein said primary turret is mounted on said first and second work tops such that said primary turret bridges said raceway.

29. A cluster of work stations according to claim 23, wherein said housing means of each of said desk systems includes a first support surface on which said at least one of said computer data monitors rests and a second support surface on which said at least another of said computer data monitors rests, said first and second support surfaces sloping downwardly into said raceway from opposite sides of said turret and being spaced apart a distance sufficient to provide access to said computer data monitors from within said raceway.

30. A cluster of work stations according to claim 23, wherein said raceway of each of said desk systems is large enough to constitute a crawlspace.

* * * * *